US005459913A

United States Patent [19]

Lechner et al.

[11] Patent Number: 5,459,913

[45] Date of Patent: Oct. 24, 1995

[54] HEALD CARRIER RAILS HAVING CONTROL CLAMPS FOR HOLDING RAILS AND LIMITING MOVEMENT OF HEALDS

[75] Inventors: Theophil Lechner, Landquart; Janos Magdika, Trübbach, both of Switzerland

[73] Assignee: Staubli AG, Horgen, Switzerland

[21] Appl. No.: 304,199

[22] Filed: Sep. 12, 1994

[30] Foreign Application Priority Data

Sep. 13, 1993 [CH] Switzerland ..... 02751/93

[51] Int. Cl.[6] ..... D03J 1/14

[52] U.S. Cl. ..... 28/208; 28/205

[58] Field of Search ..... 28/204, 205, 206, 28/207, 208

[56] References Cited

U.S. PATENT DOCUMENTS

| | | | |
|---|---|---|---|
| 1,430,629 | 10/1922 | Corrigan | 28/207 |
| 4,891,871 | 1/1990 | Tachibana et al. | 28/206 X |
| 4,916,785 | 4/1990 | Tachibana et al. | 28/206 |
| 5,136,762 | 8/1992 | Gironi | 28/205 X |
| 5,184,380 | 2/1993 | Benz et al. | 28/206 X |
| 5,249,339 | 10/1993 | Wilhelm et al. | 28/204 |
| 5,274,894 | 1/1994 | Wilhelm et al. | 28/202 |
| 5,287,605 | 2/1994 | Badertscher | 28/207 |
| 5,361,467 | 11/1994 | Jaeger et al. | 28/205 |

FOREIGN PATENT DOCUMENTS

| | | | |
|---|---|---|---|
| 481183 | 4/1992 | European Pat. Off. | 28/204 |

OTHER PUBLICATIONS

"Automatic Drawing-in Equipment", Uster EMU, Zellweger Uster, Ltd., Switzerland, 8 pages, Jul. 1982.

Uster Delta, Zellweger Uster, 17 pages, Aug. 1989.

*Primary Examiner*—John J. Calvert

*Attorney, Agent, or Firm*—Burns, Doane, Swecker & Mathis

[57] ABSTRACT

The heald handling apparatus contains carrier rails for the storage of the healds and a transport device for feeding the healds to a separating station. Each carrier rail is held by a plurality of controlled clamps and is thereby subdivided into a plurality of sections, each for receiving a heald set. The transport of the healds takes place in sets from section to section, the clamp located between the respective sections being opened. The control of the clamps takes place by means of sensors assigned to the clamps, at least one sensor being provided for each pair of clamps belonging together. The heald handling apparatus can be used in connection with healds having closed end loops and healds having open end loops.

12 Claims, 7 Drawing Sheets

HEALD CARRIER RAILS HAVING CONTROL CLAMPS FOR HOLDING RAILS AND LIMITING MOVEMENT OF HEALDS

FIELD OF THE INVENTION

The present invention relates to an apparatus for handling healds. More particularly, the present invention pertains to a heald handling apparatus for warp-thread drawing-in machines which involves the separation of the healds for the purpose of providing them for the drawing-in of the warp-threads.

BACKGROUND OF THE INVENTION

U.S. Pat. No. 5,184,380 discloses an apparatus for handling and separating healds having open end loops. In this apparatus the heald carrier rails are fastened laterally to supporting arms, the connection between the carrier rails and supporting arms being made in the region of the open part of the end loops, so that the displacement of the healds on the carrier rails is not impeded by the supporting arms. This apparatus is not suitable for the handling of healds having closed end loops, however, since the supporting arms could not pass through the end loops.

An apparatus suitable for working-off healds having closed end loops is known from the drawing-in system referred to as USTER EMU (USTER being a registered trademark of Zellweger Uster AG). In this apparatus, the carrier rails form the transverse legs of a C-shaped magazine strap which is fastened by means of its vertical leg in the drawing-in machine in such a way that the free ends of the carrier rails project towards the separating station. Since, here, the carrier rails are clamped on one side only, the working-off of the healds having closed end loops can be carried out without difficulty.

Since the carrier rails, when clamped on one side, can have only a very restricted length of at most approximately 30 cm for reasons of stability, this known solution is not suitable for an automatic drawing-in machine. This is because, on the one hand, an empty magazine strap has to be exchanged for a full one at relatively short intervals and, on the other hand, every change of this kind signifies a stopping of the drawing-in machine.

OBJECT AND SUMMARY OF THE INVENTION

An object of the present invention is to provide a heald handling apparatus which allows a fully automatic handling of even healds having closed end loops.

This object is achieved, according to the invention, in that each carrier rail is held by a plurality of controlled clamps and the transport path of the healds on the carrier rails is thereby subdivided into a plurality of sections, each for receiving a heald set, and in that the transport of the healds takes place in sets from section to section, the clamp located between the respective sections being opened.

As a result of the use of the controlled clamps, relatively long carrier rails of a length of approximately two meters and more, on which up to 4,000 healds can be intermediately stored, can be used. Even a modem drawing-in system, such as the USTER DELTA 200, requires more than half an hour for working off a similar number of drop wires. As soon as the section which is first in the refilling direction is emptied, a further heald set can be refilled, with the result that the handling of the healds in the other sections is in no way impaired. Further, the drawing-in system is not stopped.

BRIEF DESCRIPTION OF THE DRAWING FIGURES

The invention is explained in more detail below with reference to the accompanying drawing figures in which like elements are designated by like reference numerals and wherein.

Figure 6A:
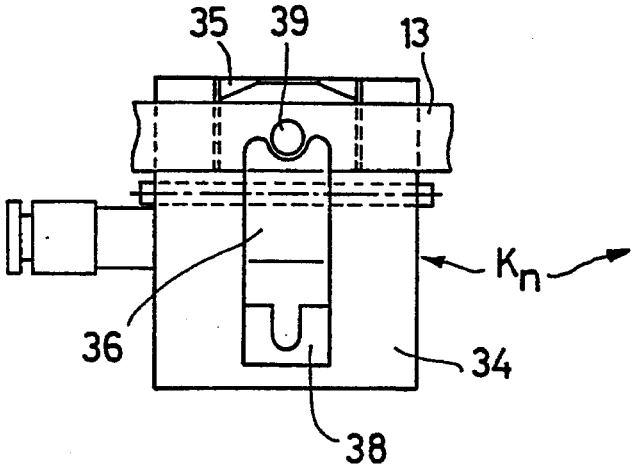
Figure 6B:
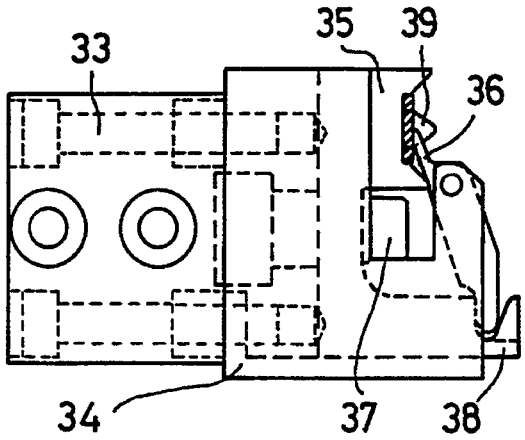
Figure 6C:
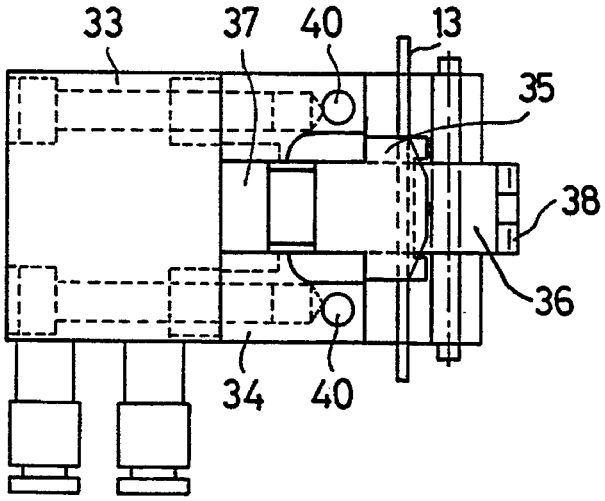

FIGS. 6*a–c* are first details of the heald module in three views; and

Figure 7A:
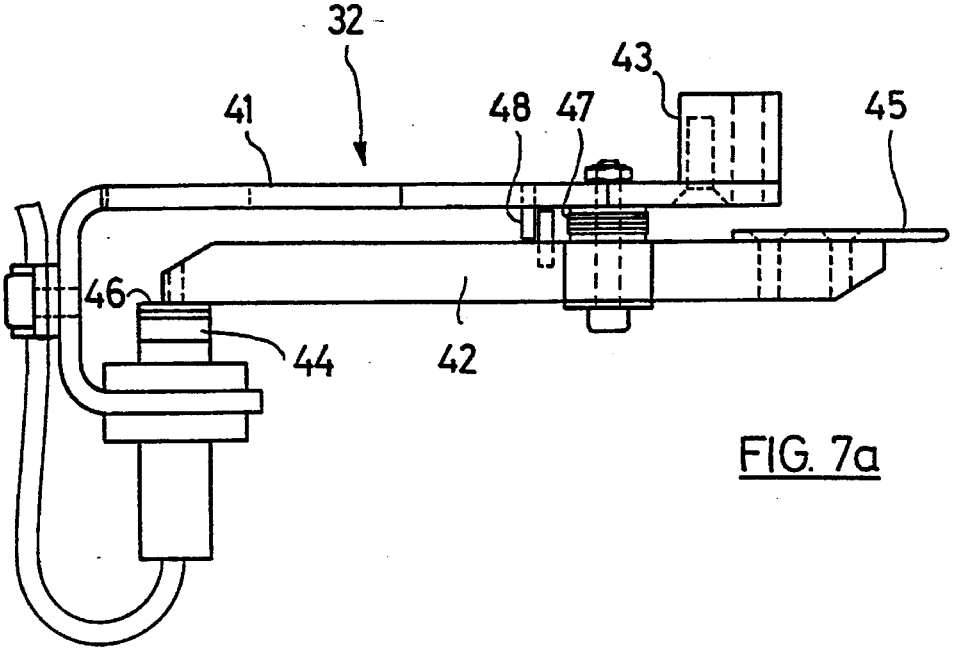
Figure 7B:
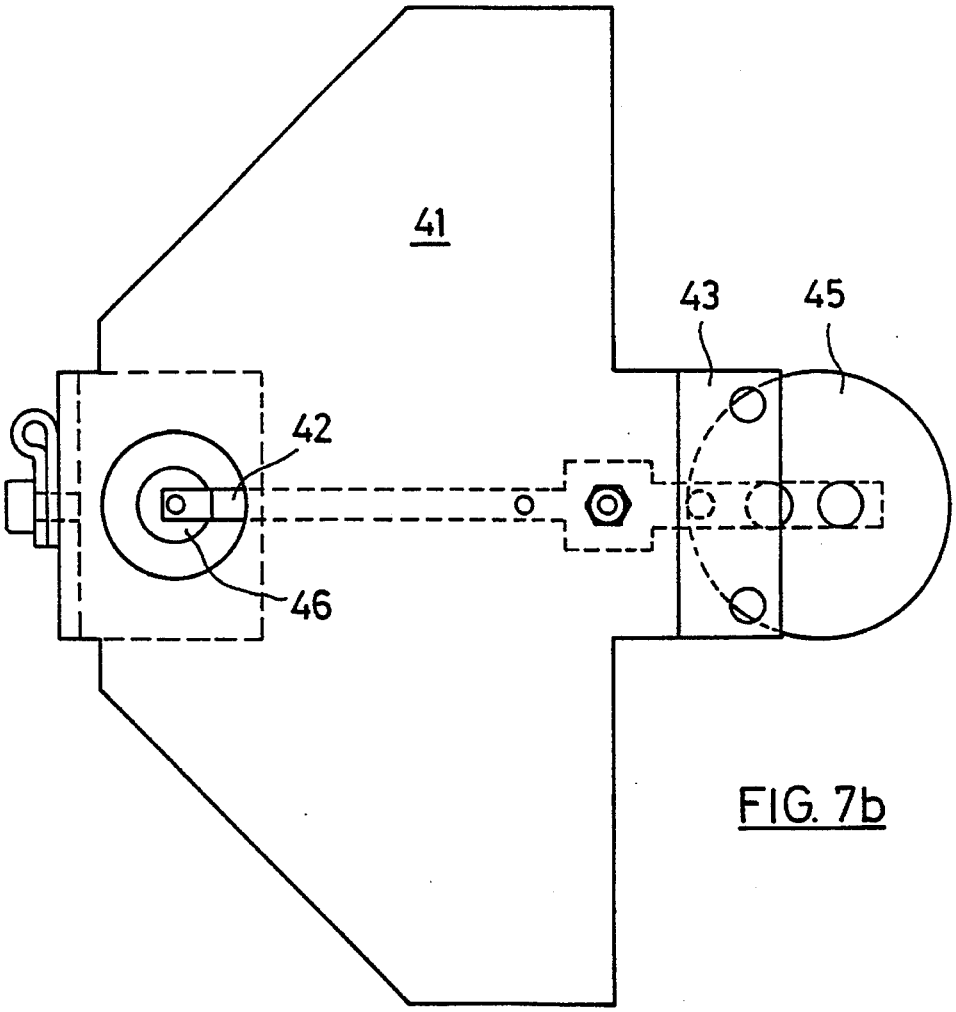

FIGS. 7*a–b* are second details of the heald module in two views.

DETAILED DESCRIPTION OF THE PREFERRED EMBODIMENT

Figure 1:
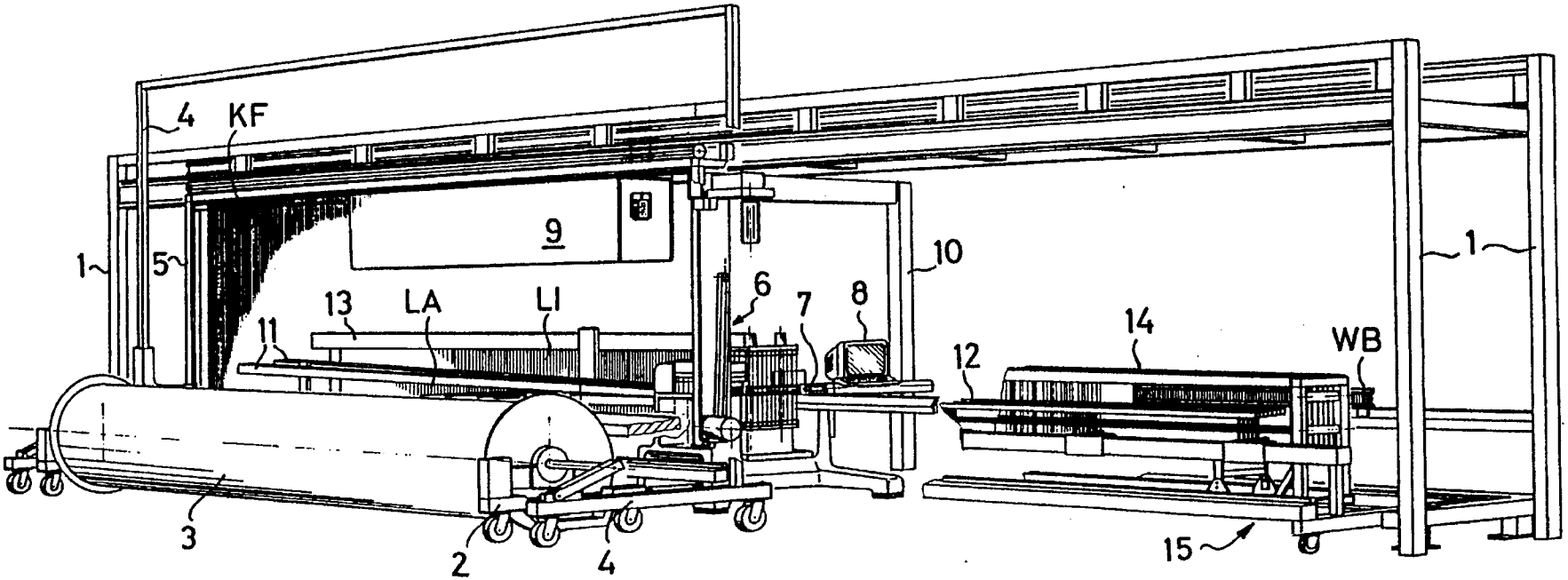
FIG. 1 is a general perspective view of a warp-thread drawing-in machine.

According to FIG. 1, the drawing-in machine consists of a basic stand 1 and various subassemblies which are arranged in the stand 1 and which each form an operating module. A warp-beam carriage 2 having a warp beam 3 arranged thereon can be seen in front of the basic stand 1. Moreover, the warp-beam carriage 2 contains a lifting device 4 for mounting a thread frame 5, on which the warp threads KF are tentered. This tentering takes place before the actual drawing-in and at a location separate from the drawing-in machine. The thread frame 5 is positioned at the lower end of the lifting device 4 in the immediate vicinity of the warp beam 3. To effect drawing-in, the warp-beam carriage 2 together with the warp beam 3 and lifting device 4 is moved up at the so-called setting-up side of the drawing-in machine, and the thread frame 5 is lifted upwards by the lifting device 4 and suspended in the basic stand 1, where it then assumes the position shown.

The thread frame 5 is displaceable in the longitudinal direction of the basic stand 1 by means of a drive (not shown). During this displacement, the warp threads KF are guided past a thread-separating group 6 forming part of a so-called yarn module and are at the same time separated and divided off. After being divided off, the warp threads KF are cut off and presented to a drawing-in needle 7 which forms an integral part of the so-called draw-in module. For dividing off the warp threads, for example the dividing-off device used in the warp-tying machine USTER TOPMATIC can be employed.

Next to the drawing-in needle 7 can be seen a video-display unit 8 which belongs to an operating station and which serves for indicating machine functions and machine malfunctions and for data input. The operating station, which forms part of a so-called programming module, also contains an input stage for the manual input of particular functions, such as, for example, crawling speed, start/stop, repetition of operations, and the like. The control of the drawing-in machine takes place by means of a control module which contains a control computer and which is arranged in a control box 9. In addition to the control computer, this control box contains a module computer for each so-called main module, the individual module computers being controlled and monitored by the control computer. The main modules of the drawing-in machine are, in addition to the modules already mentioned, namely the draw-in module, yarn module, control module and programming module, also the heald module, drop-wire module and reed module.

The thread-separating group 6, which presents to the drawing-in needle 7 the warp threads KF to be drawn in, and the path of movement of the drawing-in needle 7, which runs vertically relative to the plane of the tentered warp threads KF, determine a plane which is located in the region of a pillar 10 forming part of the basic stand and which separates the setting-up side already mentioned from the so-called stripping-off side of the drawing-in machine. On the setting-up side, the warp threads and the individual elements, into which the warp threads are to be drawn, are supplied, and on the stripping-off side the so-called harness (healds, drop wires and reed) together with the drawn-in warp threads can be extracted. During the drawing-in, the thread frame 5 together with the warp threads KF, and the warp-beam carriage 2 together with the warp beam 3 are moved to the right past the thread-separating group 6, the drawing-in needle 7 extracting from the frame 5 in succession the warp threads KF tentered on the latter.

When all the warp threads KF are drawn in and the thread frame 5 is empty, the latter, together with the warp-beam carriage 2, warp beam 3 and lifting device 4, is located on the stripping-off side and can be removed from the basic stand 1.

Arranged directly behind the plane of the warp threads KF are the warp-thread stop-motion drop wires LA, behind these the healds LI and even further to the rear the reed. The drop wires LA are stacked in hand magazines, and the full hand magazines are suspended in feed rails 11 which are arranged at an inclination and on which they are transported to the right towards the drawing-in needle 7. There, they are separated and brought into the drawing-in position. After drawing-in has taken place, the drop wires LA pass onto drop-wire carrier rails 12 on the stripping-off side.

The healds LI are lined up on rails 13 and are displaced on these manually or automatically to a separating stage. The healds LI are then brought individually into their drawing-in position and, after drawing-in has taken place, are distributed to the corresponding carrier rails 14 on the stripping-off side. The reed is likewise moved in steps past the drawing-in needle 7, the corresponding reed gap being opened for the drawing-in operation. After the drawing-in operation, the reed is likewise located on the stripping off side. Part of the reed WB can be seen on the right next to the carrier rails 14. This representation is to be understood purely as an illustration, because, in the represented position of the frame 5, the reed is, of course, located on the setting-up side.

As can also be seen from FIG. 1, there is provided on the stripping-off side a so-called harness carriage 15. This, together with the drop-wire carrier rails 12 fastened on it, the carrier rails 14 and a mounting for the reed, is pushed into the basic stand 1 into the position shown and, after the drawing-in, carries the harness together with the drawn-in warp threads KF. At this moment, the warp-beam carriage 2 together with the warp beam 3 is located directly in front of the harness carriage 15. The harness is now transferred by means of the lifting device 4 from the harness carriage 15 onto the warp-beam carriage 2 which then carries the warp beam 3 and the drawn-in harness and which can be moved up to the respective weaving machine or into an intermediate store.

The functions described are distributed to a plurality of modules which constitute virtually independent machines controlled by a common control computer. The cross-connections between the individual modules run by way of this overriding control computer, and there are no direct cross-connections between the individual modules. The already mentioned main modules of the drawing-in machine are themselves again of modular construction and consist, as a rule, of part modules.

Figure 2:
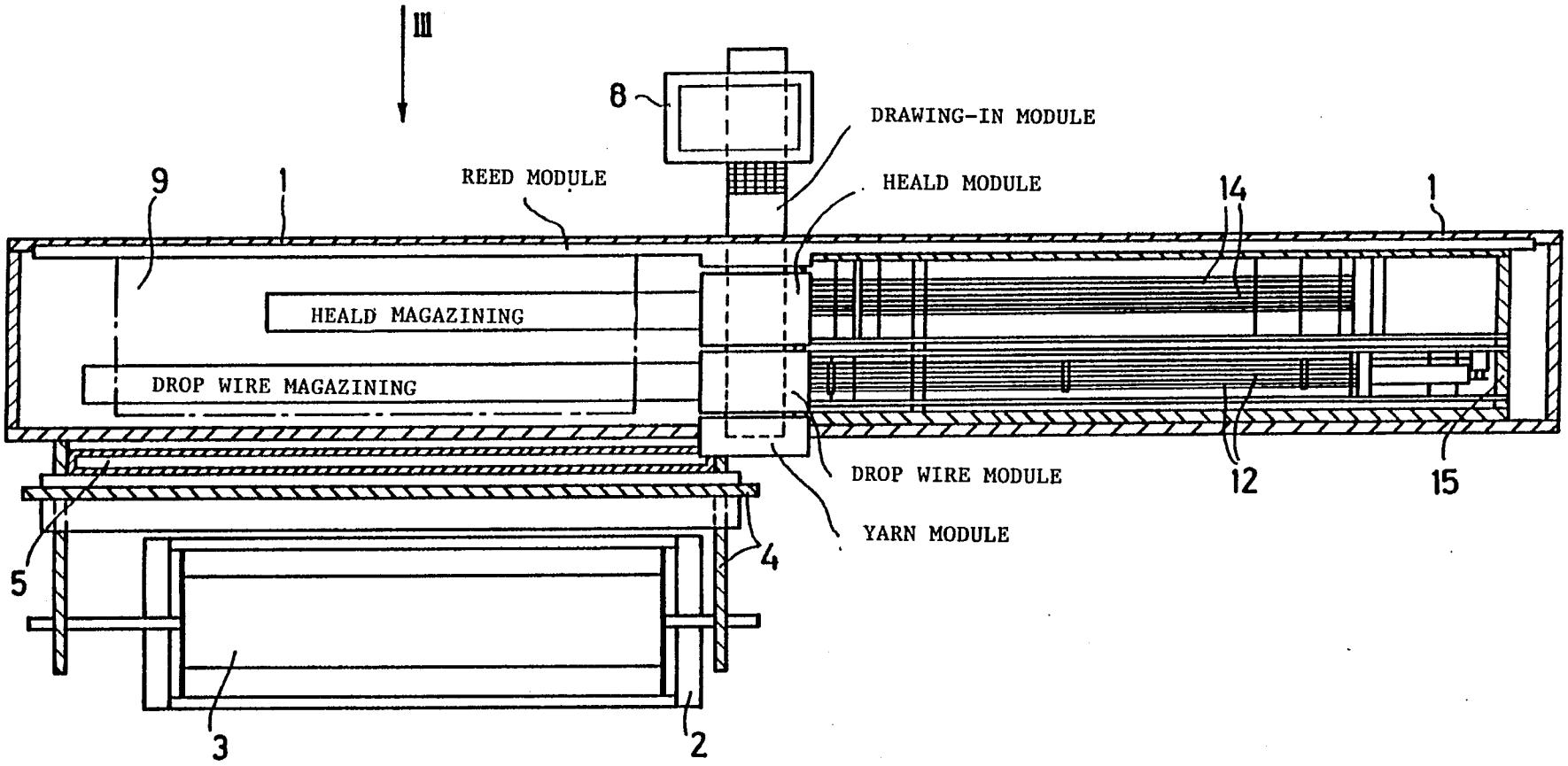
FIG. 2 is a diagrammatic top view of the drawing-in machine of FIG. 1.

This modular construction, which is described in Swiss Application No. 679,871, can be seen especially clearly from the representation of FIG. 2. FIG. 2 shows the basic stand 1, the warp-beam carriage 2 together with the warp beam 3, the lifting device 4 and the thread frame 5 which are coupled together with the warp-beam carriage 2, the yam module, the drop-wire module, the heald module, the reed module, the operating station with the video-display unit 8, the drawing-in module, the control box 9, the "heald magazining" part module, the "drop-wire magazining" part module and the harness carriage 15 together with the drop-wire carrier rails 12 and the carrier rails 14.

As can be seen from Swiss Application No. 679,871 already mentioned, the heald module, which works off the healds LI from the magazine stack up to the heald carrying a drawn-in warp thread, on a carrier rail 14, consists of the following part modules performing the following functions:

Heald magazine: acceptance of the healds by the user from the stack, transfer of the heald stacks onto the "heald separation" part module.

Heald separation: reception of the heald stacks, separation of the healds from the stack, transfer of the separated healds onto the "heald positioning" part module.

Heald positioning: take-over of the healds from the "heald separation" part module, transport of the healds to the drawing-in position, lateral and vertical positioning of the healds, transport of the healds together with the drawn-in warp thread to the predetermined carrier-rail position, transfer of the healds onto the respective carrier rail.

Heald conveyance: conveyance of the healds together with the drawn-in warp threads along the carrier rails from the filling-up side to the other end.

The "heald separation" part module is described in U.S. Pat. No. 5,184,380, and the "heald positioning" part module is described in European Patent Application No. 500,848 (= WO-A-92/05303). The "heald magazine" part module will now be described below.

Figure 3:
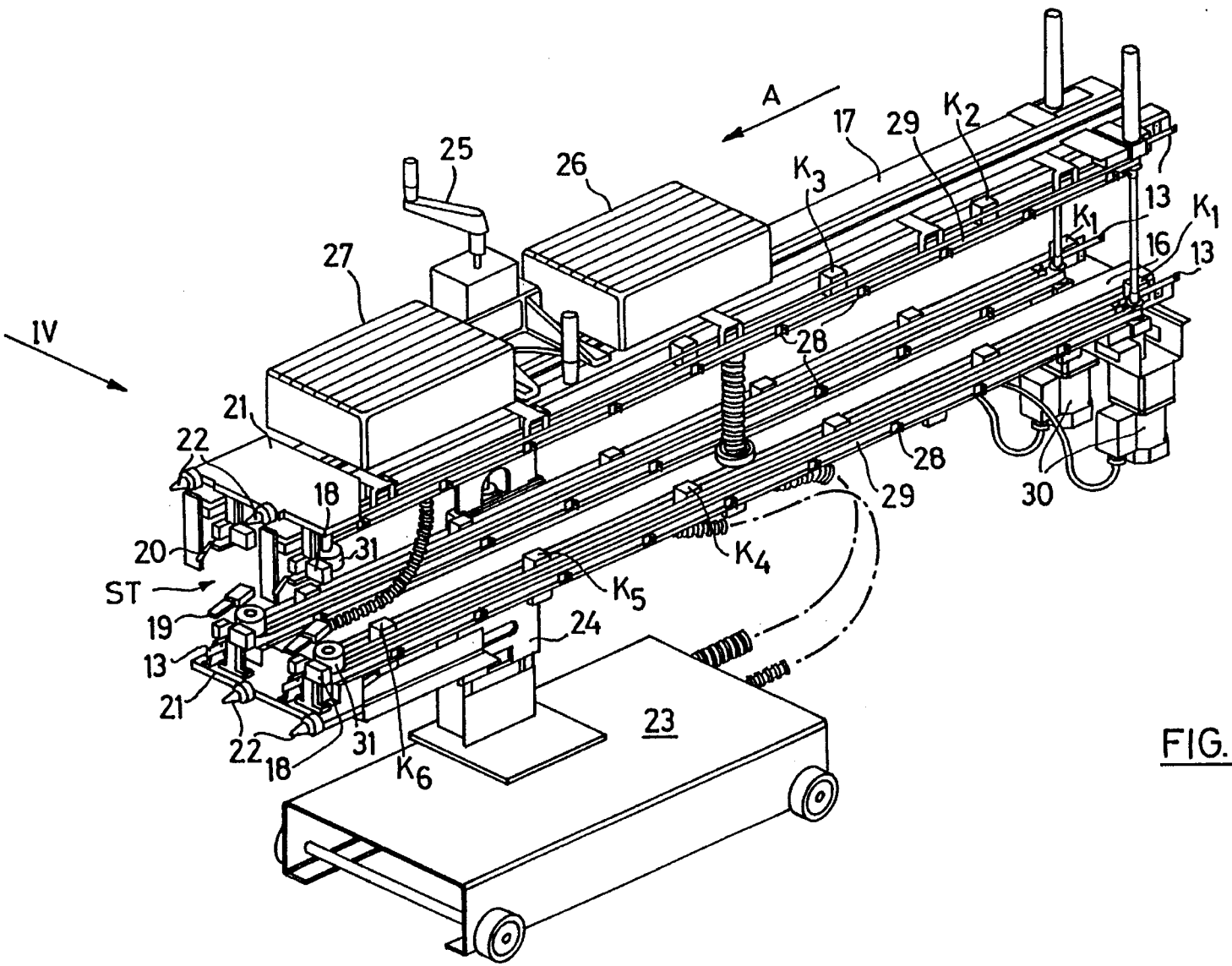
FIG. 3 is a perspective view of the heald module of the drawing-in machine of FIG. 2 as seen in the direction of the arrow III of FIG. 2.

As can be seen from FIG. 3, the heald magazine consists essentially of a lower and an upper profiled rail 16 and 17, in which are mounted the heald carrier rails 13 and means for conveying the healds lined up on the carrier rails to the separating station. The separating station, designated by ST in the figure, directly follows the heald carrier rails 13, the separating station ST respectively possesses for each heald carrier rail 13 an upper and a lower separating stage with a piston 18 movable transversely relative to the heald stack and one or two transferrers 19. Moreover, a common separating finger 20 is provided for the two separating stages. All these members are described in detail in U.S. Pat. No. 5,184,380, the entire disclosure of which is incorporated herein by reference.

As illustrated, the heald magazine is of a two-path design and contains two pairs of heald carrier rails 13 and separating stages. Fastened to the end face of each of the profiled rails 16 and 17 which is located on the same side as the separating stage is a solid plate 21 which carries two tenons 22 projecting away on the end face. These tenons serve as an interface with the "heald positioning" part module and are provided for engagement and fixing in corresponding recesses of this part module.

The two profiled rails 16 and 17 are fastened in a vertically adjustable manner on a carrier 24 mounted on a rail-guided sliding carriage 23. The distance between the end loops of the healds can be adjusted for by means of a crank 25. The offset of the thread eyes is likewise adjustable. A housing having the electrics and electronics is designated by the reference numeral 26 and a housing for the pneumatic control is designated by the reference numeral 27. The two housings are connected via corresponding lines to the sliding carriage 23 which is itself connected to corresponding supply and data lines of the drawing-in machine and which is thereby also connected, in particular, to the control module in the control box 9 (FIGS. 1 and 2).

Held on each profiled rail 16, 17 are two heald carrier rails 13 which extend from the end of the profiled rails on the right in FIG. 3, that is to say the feed side of the heald magazine, as far as the separating station ST and which have a length of more than two meters. The healds to be magazined are lined up on so-called transfer rails (not shown), that is to say a pair of rails which are connected to one another at one end by means of a web and which project freely forwards from this web. The web serves not only as a carrier of the transfer rails, but is also a kind of grip for handling the rails. To fill the heald magazine, the transfer rails together with the healds located on them are docked by means of clamps up against the feed-side ends of the heald carrier rails 13 and are pushed onto the heald carrier rails.

After a relatively short displacement by hand, the healds come into the effective range of a transport means which conveys the healds in the direction of the arrow A towards the separating station ST. This transport means is formed by a conveyer belt 29 equipped with laterally projecting brushes 28 contacting the healds, a conveyer belt 29 of this type being arranged along each heald carrier rail 13. Each pair of conveyer belts 29 which is assigned to a path of the heald magazine is driven by its own motor 30. Arranged just in front of the separating station ST, laterally next to each heald carrier rail 13, is a motor-driven pressure brush 31 which conveys the healds towards the respective separating stage and which ensures a constant build-up of pressure in the separating station ST.

The heald magazine shown in FIG. 3 can be used universally and is suitable for magazining healds having open end loops and those having closed end loops. Healds having open end loops can be magazined without difficulty because they have hook-like end loops and can therefore be displaced on the carrier rails without difficulty when only the carriers holding the carrier rails are located in the region of the open pan of the end loops, that is to say in the jaw of the hook. In contrast, healds having closed end loops can be displaced only on carrier rails free all-round, but this cannot be put into practice in the case of carrier rails having a length of more than half a meter. In the heald magazine illustrated, the displaceability of healds having closed end loops on the heald carrier rails 13 becomes possible in that each heald carrier rail 13 is held by a plurality of controlled clamps $K_1$ to $K_6$ and the transport path of the healds on the carrier rails is thereby subdivided into a plurality of sections, each receiving a heald set. The transport of the healds takes place in sets from section to section, and during the displacement from one section to the next the respective clamp located between these sections is opened.

The opening and closing of the clamps $K_1$ to $K_6$ are controlled in such a way that two clamps located next to one another can never be opened simultaneously. To control the clamps, detectors 32 (FIGS. 7*a*, 7*b*) for the passage of the healds are arranged in the immediate vicinity of the clamps. When the heald magazine is empty and the first heald stack is pushed from the transfer rails onto the heald carrier rails 13, the detector 32 located at the first clamp $K_1$ detects the presence of this heald stack at the first clamp and opens the first clamp. The heald stack can thus pass through the first clamp and come into the effective range of the conveyer belt 29 equipped with the brushes 28 so as to be pushed automatically by the conveyer belt 29 to the second clamp $K_2$.

After a specific adjustable time span of, for example, nine seconds, the first clamp $K_1$ is closed and the automatic transport of the heald stack to the separating station ST, taking place in steps from clamp to clamp, commences. As soon as the clamp $K_1$ is closed again and the detector 32 detects the presence of healds at the clamp $K_2$, the clamp $K_2$ is opened, specifically until its detector no longer detects any healds. The clamp $K_3$ is then opened, and so on and so forth. As soon as the section between the clamps $K_1$ and $K_2$ is empty and the clamp $K_2$ is closed again, a new heald stack can be transferred from the transfer rails. During the transport of a heald stack through the not completely empty, but at least partially filled heald magazine, the opening of a clamp depends on a further criterion, specifically on whether the section following the clamp to be opened is empty. Whether this criterion is fulfilled is detected by means of the signal from the detector at the clamp concluding the section in the direction of transport A. When this detector records the complete passage of the previous heald stack, then the respective section is empty. The signals from the individual detectors are processed in a common control in the housing 26, and, on account of the transport of the heald stacks in sets from section to section, the control always "knows" in which section a specific heald stack is just located, and which sections are empty and which are full. Build-ups in the sections or an overfilling of these are thereby prevented.

Figure 4:
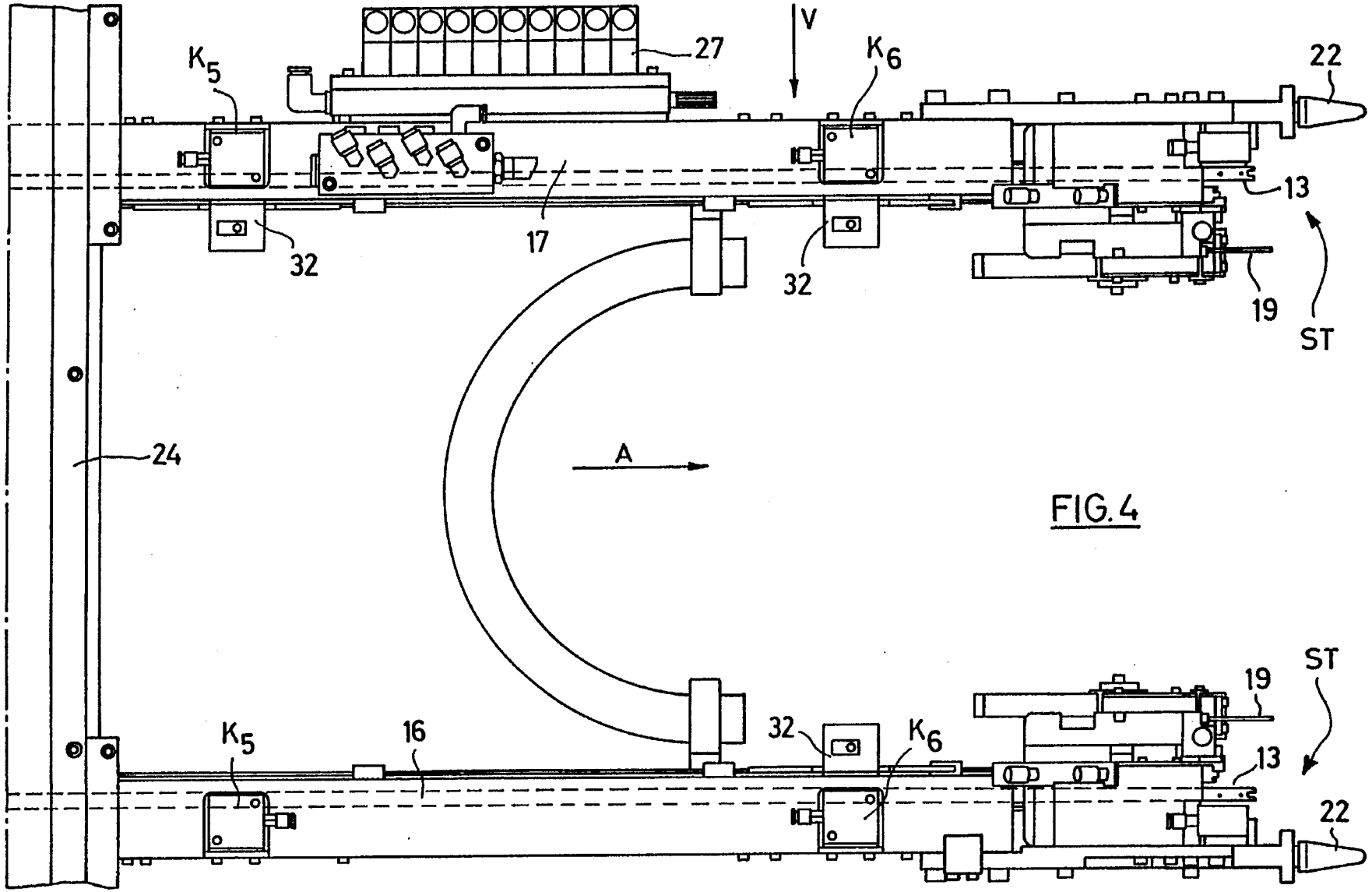
FIG. 4 is a side view of the heald module in the direction of the arrow IV of FIG. 3.
Figure 5:
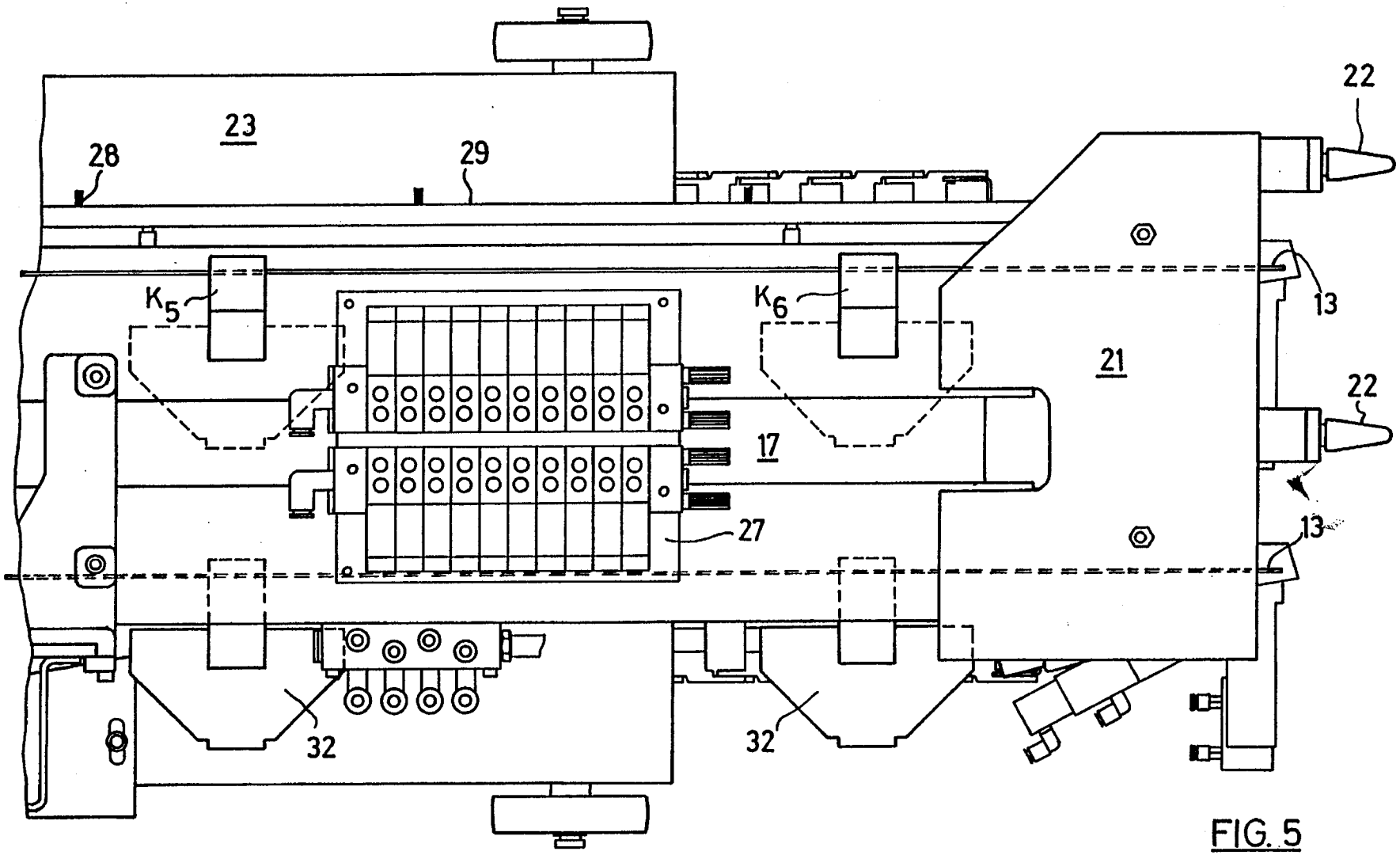
FIG. 5 is a top view of the heald module in the direction of the arrow V of FIG. 4.

The clamps and the detectors will now be described in more detail below by means of FIGS. 4 to 7. FIGS. 4 and 5 show the arrangement of the clamps and detectors respectively in a side view and in a top view of the heald-magazine head end carrying the separating station ST, FIGS. 6*a* to 6*c* show three views of a clamp, and FIGS. 7*a* and 7*b* show two views of a heald detector.

As can be seen from FIGS. 4 and 5, in the case of the clamps $K_6$ which are the foremost in the direction of transport A, a detector 32 is provided both at the clamp on the upper profiled rail 16 and the clamp on the lower profiled rail 17, the detectors being arranged within the clamps. The detector 32 at the upper clamp $K_6$ is thus located below the clamp while the detector 32 at the lower clamp $K_6$ is located above the clamp. As a comparison of the two pairs of clamps $K_5$ and $K_6$ shows, a detector 32 is provided only at the top on the pair of clamps $K_5$. The latter also applies to the remaining clamps $K_1$ to $K_4$ which likewise have a detector 32 only at the upper clamp.

FIG. 6*a* shows a view of a clamp $K_n$, as seen in the direction opposite to the arrow IV in FIG. 3. FIG. 6*b* shows a view from the left in relation to FIG. 6*a* and FIG. 6*c* shows a view from above in relation to FIG. 6*b*. As illustrated, the clamp $K_n$ is of gripper-like design and consists essentially of a pneumatic cylinder 33, a guide block 34 connected fixedly to the pneumatic cylinder 33 and a clamping gripper having two clamping jaws 35 and 36. The latter is driven by a piston 37 of the pneumatic cylinder 33 and consists of an approximately L-shaped carriage 38 displaceable in the guide block 34, a guide 35 fastened to the carriage 38 and forming one clamping jaw for the heald carrier rail 13, and a pivoting lever 36. The lever 36 is mounted in the guide block 34 which can be driven by the carriage 38, and forms the second clamping jaw which fixes the heald carrier rail 13 in the guide 35. This design of the clamping jaw allows a rapid loosening of the clamping and release of the heald carrier rail. When the piston 37 and therefore the carriage 38 are moved to the left out of the clamping position shown in FIG. 6*b*, the guide 35 moves to the left, i.e., away from the heald carrier rail 13. In addition, the pivoting lever 36 is also pivoted away from the heald carrier rail 13.

As regards the clamp $K_n$ illustrated in FIGS. 6*a* to 6*c*, the guide 35 is provided with a fixing cone 39, around which the clamping end of the pivoting lever 36 engages semicircularly. The fixing cone 39, which is provided only on the first clamp $K_1$, serves for engagement into a corresponding bore in the heald carrier rail 13, with the result that the heald carrier rails are additionally fixed at the end. The guides 35 have an approximately trapezoidal cross-section, the oblique flanks serving to ensure that during the clamping operation the heald carrier rail 13 is pushed reliably into the bottom of the guide 35, the bottom being stepped according to the carrier-rail cross-section. Moreover, the oblique flanks form a safeguard against a possible falling down of the heald carrier rail, although this is extremely unlikely.

Two vertical bores 40 in the guide block 34 which can be seen in FIG. 6*c* are provided for receiving screws that serve for connecting the clamp $K_n$ to the respective heald detector 32. The position of the clamp $K_n$ shown in FIGS. 6*a* and 6*b* reproduces, at the top and bottom respectively, a clamp arranged on the lower profiled rail 16 (FIGS. 3 and 4). On the upper profiled rail 17, the clamps $K_n$ are rotated correspondingly through 180° so that the point of engagement of the pivoting lever 36 into the carriage 38 is located in the upper half of the figure and the clamping end of the pivoting lever 36 in the lower half of the figure.

FIG. 7*a* shows a side view of a heald detector 32, as seen in the longitudinal direction of an upper heald carrier rail 13, specifically opposite to the direction of transport A (FIG. 3). FIG. 7*b* shows a top view of FIG. 7*a*. As illustrated, the heald detector 32 consists of a wing-like carrier part 41 turned around on itself at one end, and a sensor lever 42 fastened pivotably to the carrier part 41. The carrier part 41 carries, at one end, a fastening part 43 provided for fastening to a clamp $K_n$ (bores 40) and, at its other turned end, an inductive sensor 44. The sensor lever 42 projects at its front end beyond the carrier part 41 and at this end carries a small circular plate 45 projecting into the path of movement of the healds. Fastened to the rear end of the sensor lever 42 is a small metal plate 46 which is located exactly above the inductive sensor 44 in the position of rest of the sensor lever 42 shown in FIGS. 7*a* and 7*b*. A restoring spring 47 which engages the sensor lever 42 presses the latter into the position of rest, in which the sensor lever 42 is fixed by a stop pin 48.

When a heald set is pushed against a clamp $K_n$ and it reaches the clamp, it then encounters the small plate 45 of the sensor lever 42, with the result that the lever 42 is pivoted and the inductive sensor 44 responds. After the heald set has passed, the spring 47 pivots the sensor lever 42 into its position of rest again, this likewise being recorded by the inductive sensor 44.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. Apparatus for handling healds for a warp thread drawing-in machine, comprising a plurality of carrier rails for storing healds, transport means for moving the healds along a transport path to a separating station at which the healds are separated for purposes of providing the healds for warp-thread drawing-in, a plurality of controlled clamps for holding each of the carrier rails, the controlled clamps being spaced apart to subdivide the transport path into a plurality of sections the healds being transported in sets from section to section along the transport path with the clamp located between adjacent sections being opened to allow the healds to move past the clamp.

2. Apparatus according to claim 1, wherein the clamps are controlled so that with respect to any two successive clamps, only one is opened at any given time.

3. Apparatus according to claim 2, wherein each clamp includes a clamping gripper comprised of two clamping jaws which are actuated in order to open and close the clamp.

4. Apparatus according to claim 3, wherein the two clamping jaws are driven by a common drive, one clamping jaw being formed by a lifting part connected to said common drive, and the other clamping jaw being formed by a pivoting lever.

5. Apparatus according to claim 4, wherein the lifting part is guided in a fixed guide pan and is in engagement with the pivoting lever, the pivoting lever being mounted on the guide part.

6. Apparatus according to claim 1, wherein each pair of clamps has at least one detector associated therewith for detecting the presence of healds adjacent the clamps.

7. Apparatus according to claim 6, wherein the clamps include an upper clamp and a lower clamp, the detector being arranged on the upper clamp.

8. Apparatus according to claim 7, including two detectors provided at the pair of clamps adjacent the separating station, one detector being arranged on the upper clamp and one detector being arranged on the lower clamp.

9. Apparatus according to claim 6, wherein the detectors have an adjustable sensor lever projecting into the transport path of movement of the healds and a sensor detecting the adjustment of the sensor lever.

10. Apparatus according to claim 9, wherein the sensor is formed by an inductive sensor.

11. Apparatus according to claim 10, wherein the sensor lever is two-armed and includes opposite lever ends in which one lever end projects into the transport path of movement of the healds and the other lever end is located in an effective range of the inductive sensor.

12. Apparatus according to claim 11, including a spring which presses the sensor lever against a stop toward a position of rest.

* * * * *